US010624522B1

(12) United States Patent
Chan

(10) Patent No.: US 10,624,522 B1
(45) Date of Patent: Apr. 21, 2020

(54) DISHWASHER CLEAN/DIRTY INDICATOR

(71) Applicant: Henry Chan, Forest Hills, NY (US)

(72) Inventor: Henry Chan, Forest Hills, NY (US)

( * ) Notice: Subject to any disclaimer, the term of this patent is extended or adjusted under 35 U.S.C. 154(b) by 221 days.

(21) Appl. No.: 15/943,708

(22) Filed: Apr. 3, 2018

Related U.S. Application Data

(60) Provisional application No. 62/481,580, filed on Apr. 4, 2017.

(51) Int. Cl.
*A47L 15/42* (2006.01)
*G08B 21/18* (2006.01)

(52) U.S. Cl.
CPC ..... *A47L 15/4293* (2013.01); *A47L 15/4257* (2013.01); *A47L 15/4295* (2013.01); *G08B 21/18* (2013.01)

(58) Field of Classification Search
CPC ..... A47L 15/4257; A47L 15/4293; A47L 15/4295; G08B 21/18
See application file for complete search history.

(56) References Cited

U.S. PATENT DOCUMENTS 5,151,884 A * 9/1992 Griffith ..... A47L 15/0049 134/57 D
5,229,753 A * 7/1993 Berg ..... A47L 15/507 134/113
6,295,004 B1 * 9/2001 Burnett ..... A47L 15/4257 134/113
6,700,500 B1 * 3/2004 Burnett ..... A47L 15/4257 134/113
2013/0228202 A1 * 9/2013 Welch ..... A47L 15/4259 134/200

* cited by examiner

*Primary Examiner* — Ryan A Reis

(57) ABSTRACT

An automatic indicating device for showing the clean or dirty state of items in a dishwasher using a cycle sensor, a sensor to detect the openness of the dishwasher door, user input for toggling states, and logic to determine the correct state to display.

18 Claims, 6 Drawing Sheets

DISHWASHER CLEAN/DIRTY INDICATOR

CROSS-REFERENCE TO RELATED APPLICATIONS

None.

FEDERALLY SPONSORED RESEARCH OR DEVELOPMENT

Not Applicable.

SEQUENCE LISTING, A TABLE, OR A COMPUTER PROGRAM LISTING COMPACT DISK APPENDIX

Not Applicable.

BACKGROUND OF THE INVENTION

The present disclosure relates generally to dishwashers, and more particularly, to dishwasher status indicators that indicate whether dishes in a dishwasher are dirty or clean.

There are many times when a user may not be sure about the cleanliness of the dishes in a dishwasher. Typically, after a dishwashing cycle is complete on an automatic dishwasher, the user has the option to open the dishwasher, remove one or more dishes as they are needed and close the dishwasher, or the user can proceed to remove all the clean dishes from the dishwasher at once, leaving it ready for dirty dishes to be loaded. After a period of time after the cycle is complete, it can become ambiguous whether or not the dishes in the dishwasher are clean or dirty. This ambiguity is especially common in households having more than one member accessing the dishwasher, or with users who rinse dishes before placing them into the dishwasher.

Current solutions available are problematic. Some dishwashers include a cycle-complete indicator light that illuminates when the cycle is complete. These indicators turn off the next time the dishwasher door is closed, rendering them useless for subsequent openings and closings of the dishwasher door until another cycle is run.

Other problematic solutions to this problem include the use of a sign, which a user would flip and post next to, or on the front of the dishwasher door, telling others that the dishes inside the dishwasher are either clean or dirty. However, this solution can fail when the user forgets to set the sign, fooling people accessing the dishwasher later. Other solutions have included mechanical devices that when inserted inside a dishwasher, will collect water in a basin during a cleaning cycle to activate an element to indicate cleanliness. The problem with this type of solution is that differences in water patterns, placement of the device, and whether or not a dishwasher is a water conserving model can affect whether enough water will be collected to trigger the element. Even when the mechanical element activates correctly, the user is still required to manually reset the device when loading dirty dishes.

Another problem with some existing solutions is that they can only determine whether the dishwasher door is open or closed, and cannot adjust for when a door might be partially open, as in the case when a door latch is tough to close fully so the door is usually left slightly ajar. In such situations, problematic solutions can erroneously mark dishes as dirty when in fact, the door was never opened enough to take out any dishes. In solutions where the time of the dishwasher door is left open is timed, if the door is partially opened to such an extent that only the top rack is accessible, but the bottom rack is not fully accessible, such solutions could prematurely mark dishes as dirty.

When these existing problematic solutions fail often enough, users will tend to ignore what the sign or mechanical device indicates and resort to such time consuming and error-prone methods such as visual inspection and olfactory examination of the dishes inside the dishwasher to determine if they are clean or not. If a user thinks that the dishwasher hasn't been run yet when the dishes are actually clean, and proceeds to add a few dirty dishes to the dishwasher, the user will end up contaminating the entire batch of clean dishes. A user, not knowing that the dishes have already been cleaned, might end up running another cycle, cleaning already cleaned dishes and wasting resources. Not knowing whether the dishes are clean or not increases the risk of consuming foods and beverages from dirty dishes, potentially resulting in illness.

BRIEF SUMMARY OF THE INVENTION

The Dishwasher Clean/Dirty Indicator of the present invention is an automatic electronic indicator for displaying whether the dishes inside a dishwasher are clean or dirty. The invention employs a sensor to determine the degree of openness of the dishwasher door, a sensor to determine whether a cycle has completed, a provision for user input, and a clean/dirty status indicator controlled by electronic logic. The dishwasher clean/dirty indicator of the present invention eliminates the need to manually set whether the dishes are clean or dirty and eliminates reliability problems inherent in mechanical dishwasher clean/dirty indicating devices.

DETAILED DESCRIPTION OF THE INVENTION

Embodiments to be preferred of the Dishwasher Clean/Dirty Indicator of the present invention are here and in figures disclosed.

Figure 1:
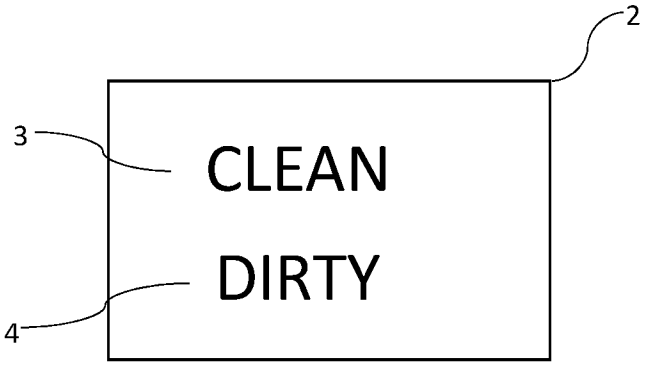
FIG. 1 is a front view of the preferred embodiment of the dishwasher clean/dirty indicator of the present invention.

Referring to the invention in more detail, in FIG. 1, there is shown a housing 2 with a translucent material making up "CLEAN" indicator 3 and a "DIRTY" indicator 4. The indicators 3 and 4 are illuminated by light-emitting diodes behind housing 2 such that when either indicator is lit, it is visible by a user when accessing the dishwasher.

Figure 2:
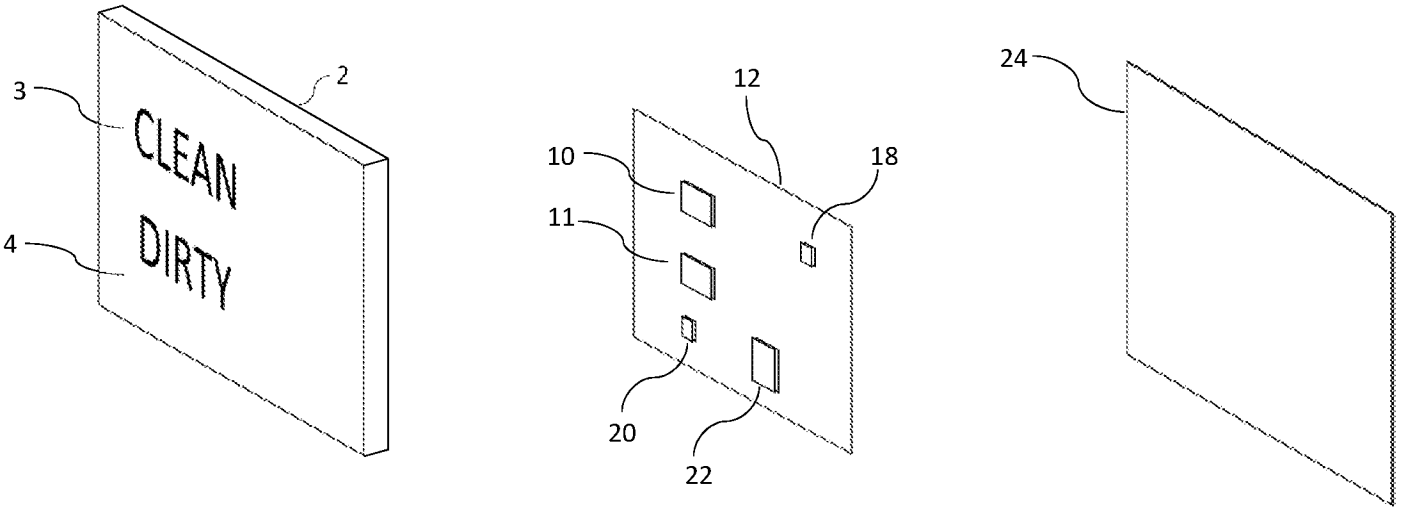
FIG. 2 is an exploded view of the preferred embodiment of the dishwasher clean/dirty indicator of the present invention.

In further detail, FIG. 2 shows an exploded view of the invention. The figure shows housing 2 with a translucent material making up "CLEAN" indicator 3 and "DIRTY" indicator 4. Indicators 3 and 4 are illuminated by light-emitting diodes 10 and 11 behind housing 2 such that when either indicator is lit, it is visible by a user when accessing the dishwasher. Circuit board 12 contains the electronics needed to perform the functions of the invention. Additionally, door openness sensor 18 and cycle sensor 20 feed door openness and cycle information to logic circuit 22, which, in the preferred embodiment, is a microcontroller. In the preferred embodiment, cycle sensor 20 is a temperature sensor capable of sensing the heat produced when the dishwasher is running. It is to be appreciated that many microcontrollers integrate an on-chip temperature sensor such that a separate temperature sensor 20 would not be necessary external to the microcontroller; in such a case, the temperature would be read directly by said microcontroller.

It is to be appreciated that the cycle sensor 20 can be replaced or augmented through the use of a signal from the dishwasher itself, or a different type of sensor to determine when a cycle has sufficiently completed, without altering the inventive concepts and principles embodied therein.

The door openness sensor 18 has the ability to determine the degree of openness of the door. In the preferred embodiment, the door openness sensor 18 is an accelerometer used to determine the angle of tilt of the dishwasher door. In the preferred embodiment, the invention would be in the form of an add-on device that would be attached to the outside of the dishwasher door—for example, on the top edge of the door, or on the left or right edge of the door, or in the front of the door, such that when the door is opened, the sensor would be able to determine the door's position. Most dishwashers use vertical doors that open and tilt downward—an accelerometer could be used to sense the tilt angle of the door, indicating to the control electronics the degree of openness of the door. In dishwashers where the door is actually attached to a drawer and slides out, the sensor would sense the position of the slide; such sensors could include a linear potentiometer, or an optical encoder. In any case, the door openness sensor 18 is mounted such that it can determine the degree of openness of the door.

It is to be appreciated that the door openness sensor 18 can be replaced or augmented through the use of a signal from the dishwasher itself, or a different type of sensor, such as an optical sensor, such that the degree of openness of the dishwasher door can be determined by the control electronics, without altering the inventive concepts and principles embodied therein.

It is to be appreciated that the door openness sensor 18 can also be integrated onto a microcontroller integrated circuit, so that a separate, discrete, door openness sensor would not be needed.

A battery (not shown) can be mounted on circuit board 12, which would provide power to the electronics. An alternative embodiment may consist of a power source external to the housing 2 delivering power wirelessly, for example through induction or visible or non-visible light. Another alternative embodiment may contain a solar panel to provide power to the circuit. Back plate 24 provides a cover for housing 2, keeping electronics located on circuit board 12 free from moisture.

Still referring to FIG. 2, in the preferred embodiment, an opaque material can also be used as part of housing 2, but provisions for light transmission around LED indicators 11 and 12 would be needed. While housing 2 is depicted in FIG. 1 and FIG. 2. as rectangular, it may be of any shape without altering the function of the invention.

Figure 3:
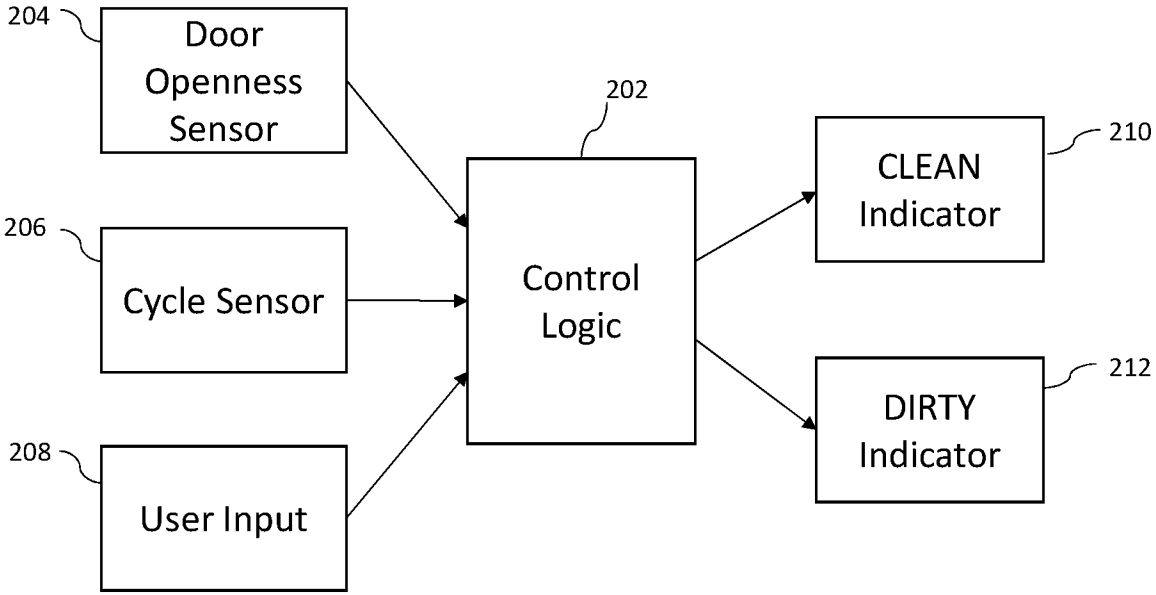
FIG. 3 is a block diagram of the operation of the dishwasher clean/dirty indicator of the present invention.

Referring now to FIG. 3, there is shown a block diagram with a high-level view of the control system of the current invention. At the inputs to the control logic circuit 202 are door openness sensor 204, which in the preferred embodiment is an accelerometer, a cycle sensor 206 to detect the activation of a dishwasher wash cycle, which in the preferred embodiment is a temperature sensor, and a provision for user input 208, which in the preferred embodiment is a knock detector, accomplished through the use of said accelerometer as door openness sensor 204. Logic in control logic circuit 202 determines if the Clean indicator 210 or the Dirty indicator 212 should be active. In the preferred embodiment, control logic circuit 202 comprises a microcontroller circuit preprogrammed with the firmware needed to control the invention.

Figure 4:
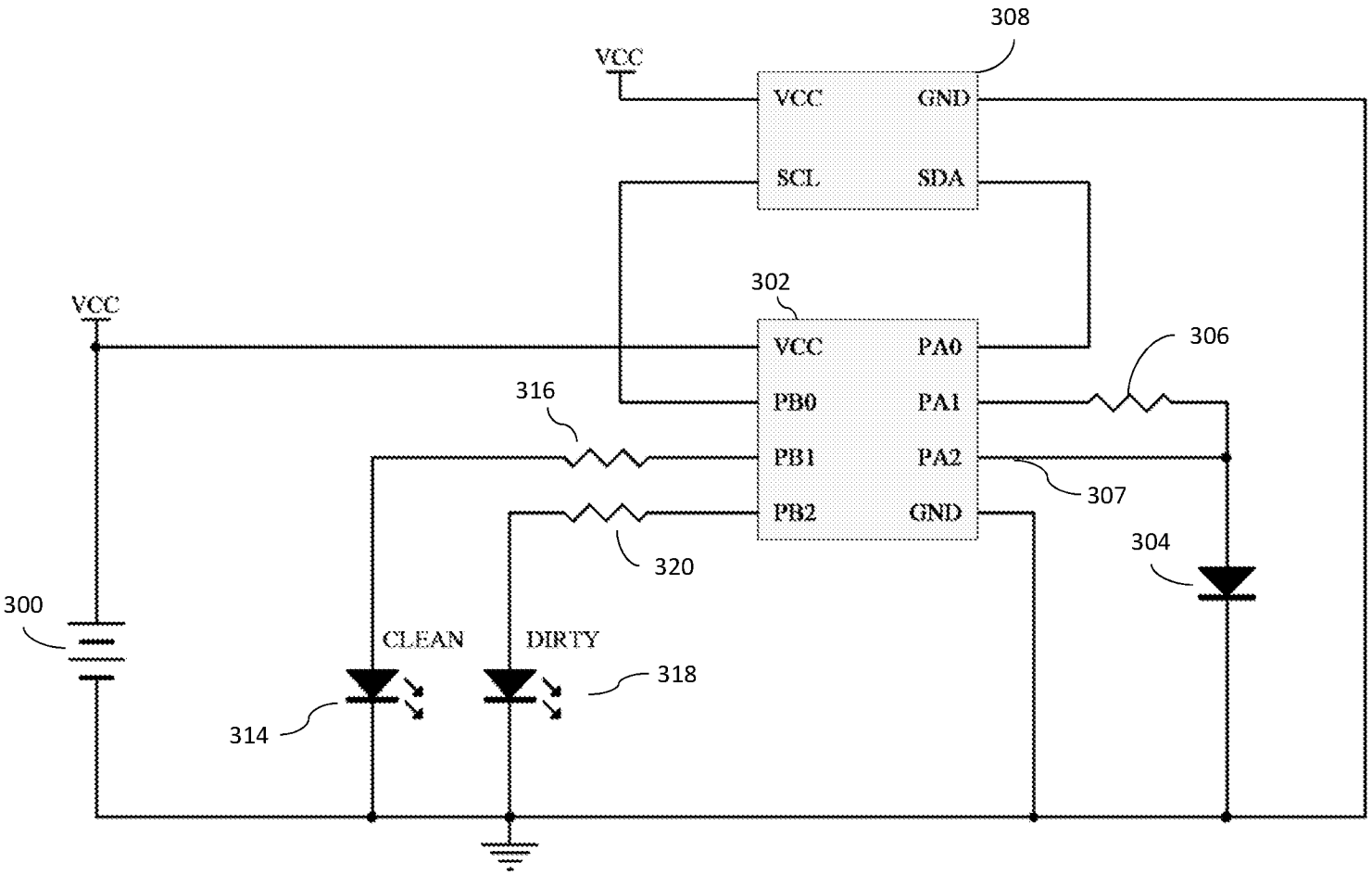
FIG. 4 is a schematic diagram of a preferred embodiment of the control circuit used in the dishwasher clean/dirty indicator of the present invention.

In further detail, FIG. 4 shows a schematic diagram of the electronic circuitry used in the preferred embodiment of the dishwasher clean/dirty indicator of the present invention. Battery 300 provides power to microcontroller 302. Microcontroller 302 is used to keep track of the clean or dirty state of the dishes. Diode 304, which is used as a temperature sensor, may be a silicon diode whose temperature coefficient is known. Resistor 306 establishes a bias current through diode 304, causing a temperature-dependent voltage to appear at input port 307 of microcontroller 302.

Still referring to the preferred embodiment in FIG. 4, door openness sensor 308, which in the preferred embodiment is a 3-axis accelerometer, is connected to microcontroller 302 using a serial interface. The microcontroller 302 is able to determine tilt in the X, Y, and Z axes with respect to gravity by communicating with said accelerometer 308. By examining the tilt, the degree of openness of the door can be determined.

Figure 5:
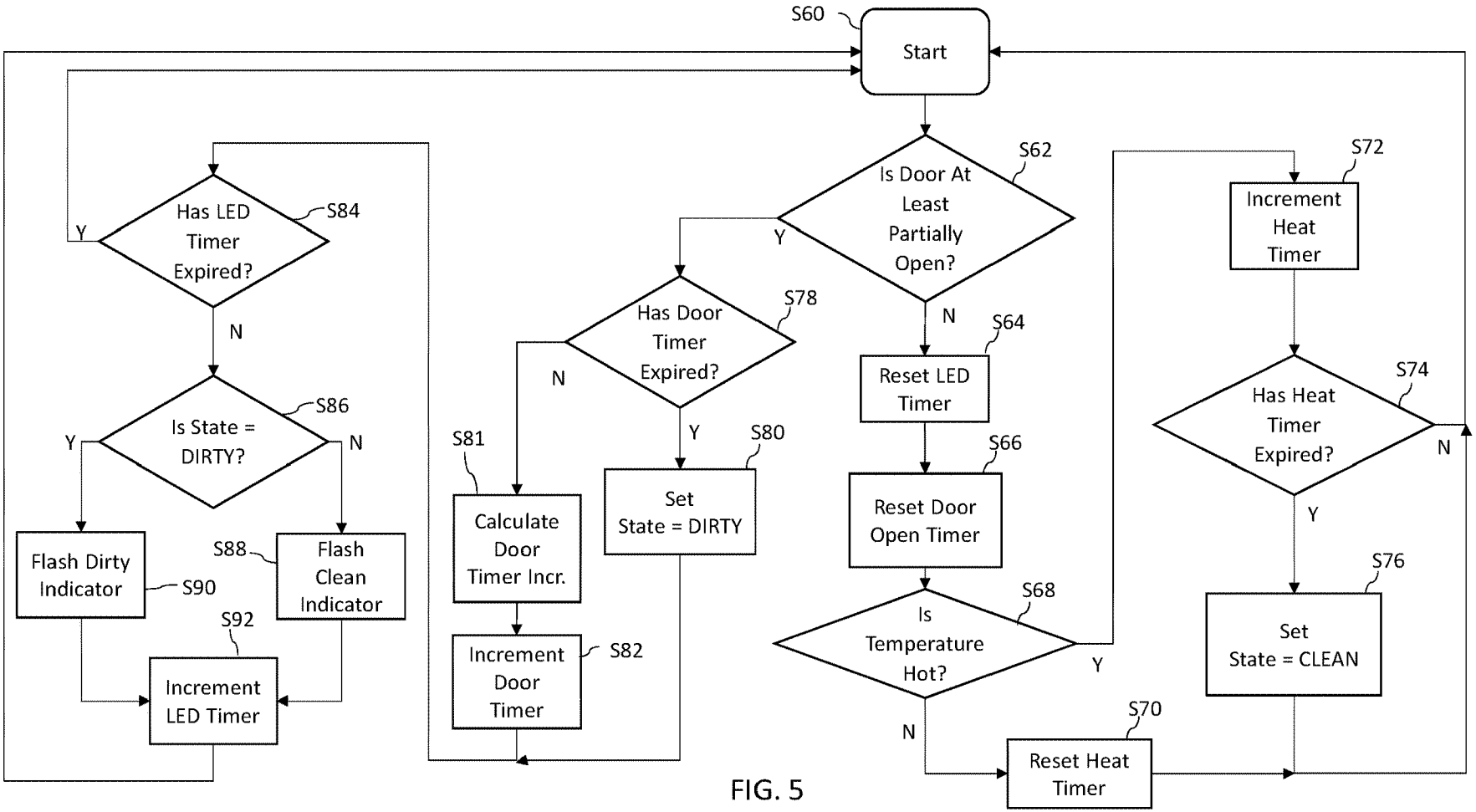
FIG. 5 is a flowchart of the operation of the firmware embedded within the microcontroller used in the preferred embodiment of the dishwasher clean/dirty indicator of the present invention.
Figure 6:
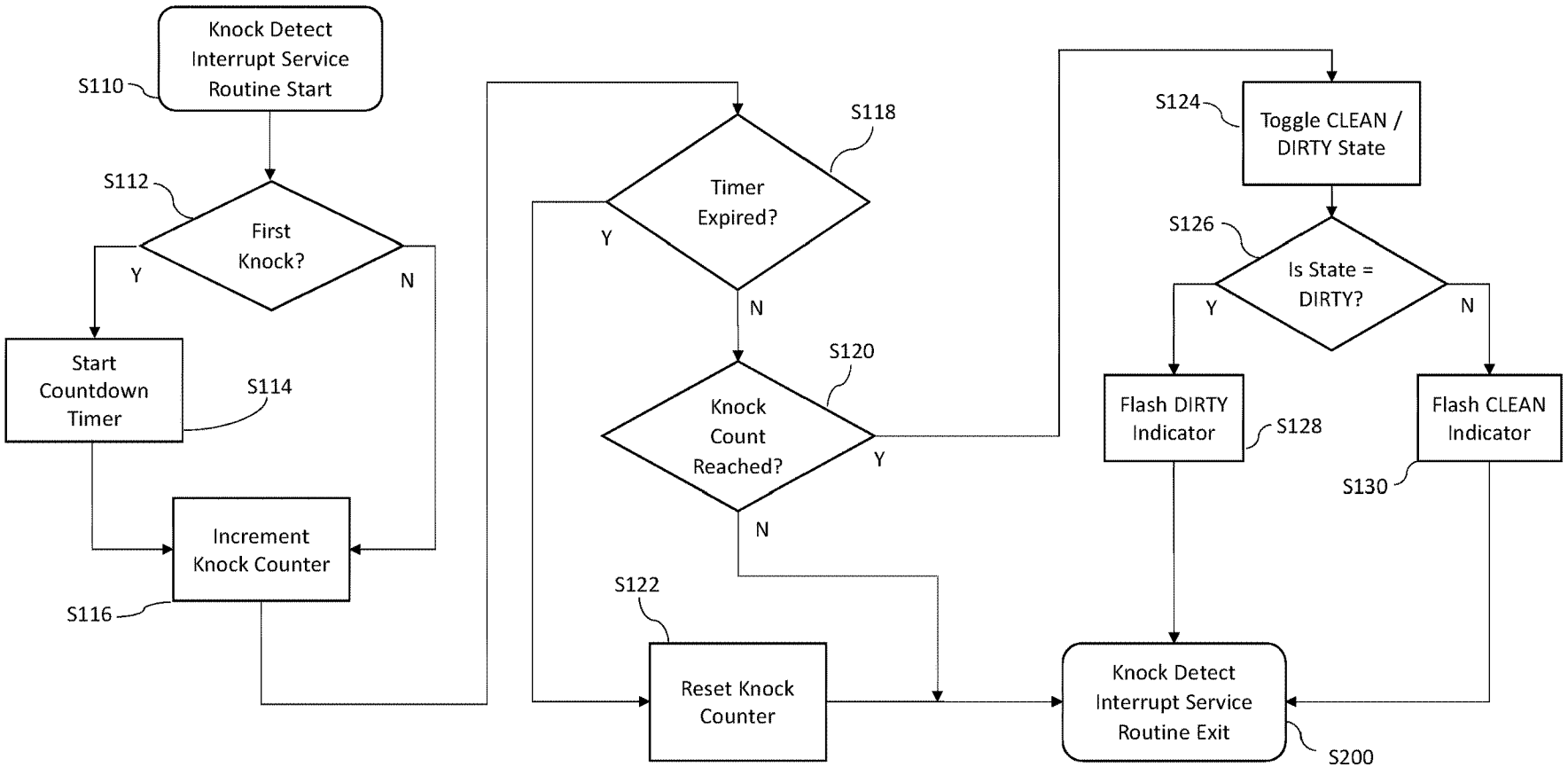
FIG. 6 is a flowchart of knock detection operation of the firmware embedded within the microcontroller in the preferred embodiment of the dishwasher clean/dirty indicator of the present invention.

Still referring to the preferred embodiment in FIG. 4, microcontroller 302 executes firmware that has been stored internally. The operation of said firmware program is illustrated in FIG. 5 and FIG. 6. When said firmware program indicates that the Clean indicator needs to be illuminated, microcontroller 302 activates light-emitting diode 314, whose current is limited by resistor 316. Similarly, when the program indicates that the Dirty indicator needs to be illuminated, microcontroller 302 activates light emitting-diode 318 whose current is limited by resistor 320.

Still referring to the preferred embodiment in FIG. 4, a user can manually toggle the state of the Clean/Dirty indicator by knocking on the invention, causing vibration to be sensed by an accelerometer 308.

Operation of the Dishwasher Clean/Dirty Indicator:

Still referring to the preferred embodiment of the invention of FIG. 1:

There are two general ways users tend to use the dishwasher.

1) Bulk Remove Clean, Store Dirty: A user who operates in this manner usually removes all the clean dishes from the dishwasher at once after a cleaning cycle is complete, and uses the dishwasher to collect dirty dishes in between cleaning cycles. When the dishwasher is full of dirty dishes, the user then initiates a cleaning cycle.
2) Store Clean, Bulk Load Dirty—A user who operates in this manner usually leaves the clean dishes in the dishwasher after a cleaning cycle is complete, and takes out clean dishes to use as they are needed. Only when the dishwasher is almost empty or completely empty will a user unload any remaining clean dishes and load dirty dishes in bulk into the dishwasher to prepare for a new cycle.

Either way, the present invention would service the needs of both types of usage without manual intervention.

To use the present invention, the user would install the dishwasher clean/dirty indicator onto the dishwasher. In the preferred embodiment, the invention is attached to the outside of the dishwasher door, such that when the door is opened, the door openness sensor can determine the degree of openness of said door. When the dishwasher clean/dirty indicator determines that the dishes have been cleaned, the state of the device is transitioned from Dirty to Clean. When the user opens up the dishwasher after the cycle is complete, the user sees an indication that the dishes are clean. The dishwasher clean/dirty indicator will now time how long the dishwasher is left open, where the total time depends on the degree of openness of the door.

If the dishwasher door is opened a small amount, for example, less than 10%, the time increment added to the dishwasher door-open timer may be zero. That way, the dishwasher door may be left slightly open for an indefinite amount of time—as in the case when the user wanted to vent the dishwasher after completion of the cycle, without actually unloading any dishes.

If the dishwasher door is opened for a larger amount, for example, 10% to 50%, the time increment added to the dishwasher door-open timer may be a fraction of the time increment that the door is actually open, for example, 0.2 seconds added for every second the door is open from 10% to 50%. This allows the user to access the dishwasher with a partly open door, perhaps just the top rack, while effectively extending the dishwasher door open timeout, so that user has a longer amount of time to access dishes without the timer expiring.

If the dishwasher door is open an even larger amount, for example, more than 50% to 100%, the time increment added to the dishwasher door-open timer may be the nominal time increment, for example, 1 second for every second the door is open more than 50%. This allows the user to access the dishwasher fully to load or unload the dishes.

It is to be appreciated that there can be many more door discrete openness levels added with corresponding time increment adjustments used to increment the door-open timer. It can also be appreciated that discrete levels of door openness do not have to be used, but instead, a continuous analog representation of door openness can be used to determine the time increment.

If the dishwasher door-open timer reaches a predetermined period of time, for example, 2 minutes, then it would indicate that the user has proceeded to empty all the clean dishes from the dishwasher and the dishwasher would be left empty. At this point, the internal state of the dishwasher clean/dirty indicator would automatically transition to Dirty. The dishwasher clean/dirty indicator would subsequently indicate to users that the dishes are dirty until the user starts a new cleaning cycle. When the user initiates the cleaning cycle, the dishwasher clean/dirty indicator would detect that the cycle has progressed sufficiently after a predetermined period of time and would automatically transition from the Dirty state to the Clean state.

If instead, the user only opens the dishwasher door for a short period, for example to take out only one or a few items, and closes the door before the door-open timer reaches the predetermined level, the internal state of the dishwasher clean/dirty indicator would still indicate Clean. That way, subsequent accesses of the dishwasher would still indicate the clean state of the dishes. When most or all the clean dishes have been used up, the user would load dirty dishes in bulk. At this point, the dishwasher clean/dirty indicator would transition to the Dirty state because the door would have been open for more than a predetermined amount of time to facilitate the bulk loading of dirty dishes.

The user has the ability to manually toggle the Clean/Dirty state by knocking on the invention, causing the accelerometer to detect vibration, and triggering the change in state from Clean to Dirty or Dirty to Clean. This allows a user to manually signify the Dirty state if, for example, the user accidentally drips dirty liquids over the dishes, contaminating the contents of the dishwasher.

Detailed Description of Firmware Operation in the Preferred Embodiment:

Referring to FIG. 5, the flow of execution of the program in the microcontroller in the preferred embodiment starts at state S60. In the next step S62, the door openness sensor is checked to detect if the dishwasher door is open at least partially, where partially may be defined as the door opening equal to or more than a predetermined amount, such as 10%. If the door is at least partially open, execution would flow to S78. At S78, the door-open timer is checked to see if it has expired. This timer is used to keep track of how long the door has been opened for. If the timer has expired, indicating that the dishwasher door was open long enough to empty all the dishes, then the state would be set to Dirty at step S80. If the door-open timer has not expired, execution would flow to S81, where the amount of time to increment the door-open timer is calculated. In this step S81, the increment would be zero if the door is only slightly open, for example, 10%; at a larger partial door opening, for example, more than 10% and less than 50%, the timer increment would be a larger amount, for example, 20% of the nominal value; at the largest door opening, for example, more than 50% to 100% open, the timer increment would be the full amount. The door-open timer is incremented in S82 by the increment calculated in S81. This variable door-open time increment would allow the door to remain slightly open for an indefinite amount of time, and wide open for a predetermined amount of time before the door-open timer expires and causes the transition of states to dirty in step S80.

After S80 and S82, execution flows to S84. At S84, the LED timer is checked to ensure that the LED is not left on for too long in order to conserve energy. If the LED timer has expired, then the execution returns to the beginning state S60. If the LED timer has not expired, the flow of execution will transition to S86, where the Clean/Dirty state is examined. If the state is Clean, then S88 will execute, flashing the Clean indicator. If the state is Dirty, S90 will execute, flashing the Dirty Indicator. After either indicators are flashed, the flow of execution continues to S92, incrementing the LED timer. The flow then returns to the Start S60.

Still referring to FIG. 5, if during step S62, the door is not determined to be at least partially open, execution flows through S64, where the LED timer is reset and through S66, where the door-open timer is reset, and subsequently to S68 where the temperature as measured in the temperature sensor is checked. If said temperature exceeds a threshold that indicates a cleaning cycle is being activated, execution moves to S72. Otherwise, if said temperature does not exceed said threshold, the heat timer is reset at S70 and flow returns to the beginning at S60. If sufficient heat is detected, the heat timer is incremented at S72 to keep track of how long heating has been occurring. At S74, the heat timer is checked to determine if there has been heating for sufficiently long to indicate that a cleaning cycle has made significant progress. If so, the internal state is set to Clean at S76. Otherwise, control returns to the start of the program at S60.

Operation of Manual State Toggling:

Referring to FIG. 6, showing the flow of execution of the program embedded in the preferred embodiment, the subroutine is entered when knocking is detected by the accelerometer at state S110. Whether the knock is the first knock detected is checked at state S112. If it is the first knock, execution moves to step S114, where the knock countdown timer is started. The execution moves to step S116, where the knock counter is incremented. If the knock detected was determined at S112 to not be the first knock, execution moves directly to S116, where the knock counter is incremented.

Still referring to FIG. 6, the flow of execution moves to S118, where the knock countdown timer is checked. If it has expired, execution moves to step S122, where the knock counter is reset, and the execution exits the subroutine at step S200. If the knock countdown timer has not expired, execution moves to S120, where the knock count is checked. If the knock count has reached a predetermined threshold, execution moves to S124, where the state Clean/Dirty state is toggled. The Clean/Dirty state is checked at step S126. If the Clean/Dirty state is Dirty, the Dirty indicator is flashed at step S128 and the flow of execution exits the subroutine at S200. If the Clean/Dirty state at S126 is Clean, the Clean Indicator is flashed at step S130 and the flow of execution exits the subroutine at S200.

It is to be appreciated that the knock detection feature used to toggle the Clean/Dirty states can be replaced or augmented through the use of a push-button, a different type of sensor, such as a touch sensor, or other means of user input without altering the inventive concepts and principles embodied therein.

It is to be appreciated that the LED's used to produce a visual indication for Clean and Dirty can be replaced or augmented through the use of an audio device such as a beeper or voice synthesizer, or a wireless link, or an electromechanically actuated sign, or any other indication device without altering the inventive concepts and principles embodied therein.

It is to be appreciated that while a microcontroller programmed with firmware is used in the preferred embodiment, alternative analog or digital logic circuits can be substituted to perform the same functions without altering the inventive concepts and principles embodied therein.

It is to be appreciated that while the preferred embodiment of the invention disclosed is an externally mounted device, an alternate embodiment can be made such that the invention is mounted to the inside of the dishwasher door, such that the invention is still able to detect the degree of door openness, detect the cycle of the dishwasher, is able to indicate to the user the Clean/Dirty state of the dishes.

It is also to be appreciated that, while the preferred embodiment of the invention disclosed is an externally added-on device, the invention can be integrated into the controls of a dishwasher by the dishwasher manufacturer, such that the degree of door openness can be detected, the cycle can be detected, and the clean/dirty state of the dishes can be indicated to the user.

Closing Statement:

Having thus described in detail preferred embodiments of the Dishwasher Clean/Dirty Indicator of the present invention, it is to be appreciated and will be apparent to those skilled in the art that many changes not exemplified in the detailed description of the invention could be made without altering the inventive concepts and principles embodied therein. It is also to be appreciated that numerous embodiments incorporating only part of the preferred embodiment are possible which do not alter, with respect to those parts, the inventive concepts and principles embodied therein. The presented embodiments are therefore to be considered in all respects exemplary and/or illustrative and not restrictive, the scope of the invention being indicated by the appended claims, and all alternate embodiments and changes to the embodiments shown herein which come within the meaning and range of equivalency of the appended claims are therefore to be embraced therein.

I claim:

1. A device for indicating the cleanliness of items in a dishwasher comprising:

a. at least one sensor capable of detecting at least three levels of openness of a door of said dishwasher;

b. at least one sensor capable of detecting whether or not a dishwasher cycle of said dishwasher is running;

c. at least one timer capable of measuring the amount of time said dishwasher door is at least partially open;

d. at least one timer capable of measuring the amount of time said dishwasher cycle is running;

e. a control circuit, capable of determining the state of cleanliness of said items in said dishwasher based on inputs comprising the time that said dishwasher door is at least partially open, at least three levels of door openness, and the time said dishwasher cycle is running; and f. at least one indicator responsive to said state of cleanliness of said items in said dishwasher as determined by said control circuit.

2. The device of claim 1, further comprising at least one sensor for user input connected to said control circuit.

3. The device of claim 1 wherein the at least one sensor capable of detecting at least three levels of openness of the door of said dishwasher comprises at least one accelerometer.

4. The device of claim 1 wherein the at least one sensor capable of detecting whether or not said dishwasher cycle is running comprises at least one sensor responsive to temperature.

5. The device of claim 1 wherein the control circuit comprises at least one microcontroller.

6. The device of claim 1 wherein the control circuit comprises a plurality of logic gates.

7. The device of claim 4 wherein the at least one sensor responsive to temperature is responsive to at least two temperatures measured over a period of time.

8. The device of claim 2 wherein the at least one sensor for user input comprises at least one switch.

9. The device of claim 2 wherein the at least one sensor for user input comprises at least one sensor capable of detecting vibration.

10. The device of claim 1 wherein the at least one indicator responsive to said state of cleanliness of said items in said dishwasher as determined by said control circuit comprises at least one light-emitting device.

11. The device of claim 1 wherein the at least one indicator responsive to said state of cleanliness of said items in said dishwasher as determined by said control circuit comprises at least one audible alert.

12. The device of claim 1 wherein the at least one indicator responsive to said state of cleanliness of said items in said dishwasher as determined by said control circuit comprises at least one wireless circuit.

13. The device of claim 1 wherein the at least one indicator responsive to said state of cleanliness of said items in said dishwasher as determined by said control circuit comprises at least one electromechanical display.

14. A device for indicating the cleanliness of items in a dishwasher comprising:

a. at least one sensor capable of detecting at least three levels of openness of a door of said dishwasher;

b. at least one sensor responsive to temperature;

c. at least one timer capable of measuring the amount of time the door has been detected to be at least partially open;

d. at least one timer capable of measuring the amount of time a temperature has been detected beyond a threshold wherein the threshold is determined by measuring at least two temperatures over a period of time;

e. a control circuit, capable of determining the state of cleanliness of said items in said dishwasher based on inputs comprising the amount of time said dishwasher door is at least partially open, and the amount of time a temperature has been detected beyond said threshold; and f. at least one indicator responsive to said state of cleanliness of said items in said dishwasher as determined by said control circuit.

15. The device of claim 14, further comprising at least one device for user input connected to said control circuit.

16. The device of claim 14, wherein the control circuit capable of determining the state of cleanliness of said items in said dishwasher based on inputs further comprising at least three levels of door openness.

17. A device for indicating the cleanliness of items in a dishwasher comprising:

a. at least one sensor capable of detecting the level of openness of a door of said dishwasher;

b. at least one timer capable of measuring the amount of time said dishwasher door is at least partially open;

c. at least one timer capable of measuring the amount of time a dishwasher cycle is running;

d. a control circuit, capable of determining the state of cleanliness of said items in said dishwasher based on inputs comprising the time that said dishwasher door is at least partially open, at least three levels of door openness, and the time said dishwasher cycle is running; and e. at least one indicator responsive to said state of cleanliness of said items in said dishwasher as determined by said control circuit.

18. The device of claim 17, further comprising at least one device for user input connected to said control circuit.

* * * * *